US007397170B2

(12) United States Patent
Ichikawa

(10) Patent No.: US 7,397,170 B2
(45) Date of Patent: Jul. 8, 2008

(54) PIEZOELECTRIC MECHANISM FOR GENERATING DISCHARGE VOLTAGE

(76) Inventor: Toshihiro Ichikawa, c/o Main Factory, Tokai Corporation, 3,4, Shimohara, Subashiri, Oyama-cho, Sunto-gun, Shizuoka (JP) 410-1431

( * ) Notice: Subject to any disclaimer, the term of this patent is extended or adjusted under 35 U.S.C. 154(b) by 234 days.

(21) Appl. No.: 11/264,673

(22) Filed: Jan. 13, 2006

(65) Prior Publication Data

US 2006/0097607 A1 May 11, 2006

(51) Int. Cl.
*H01L 41/08* (2006.01)

(52) U.S. Cl. ..... 310/339; 361/260

(58) Field of Classification Search ..... 310/339; 361/260

See application file for complete search history.

(56) References Cited

U.S. PATENT DOCUMENTS 4,130,792 A * 12/1978 Sullivan ..... 324/327

* cited by examiner

*Primary Examiner*—Mark Budd
(74) *Attorney, Agent, or Firm*—Trojan Law Offices

(57) ABSTRACT

Malfunctions caused by dusts such as sands and the like in movement portions of a spark-voltage generation mechanism are reduced. The generation mechanism comprises an outer-box assembly in which a base piece, piezoelectric element, and anvil are disposed in line with the longitudinal axis, an axis-direction cam groove is formed thereon, an inner-box assembly in which a hammer that strikes the piezoelectric element and a hammer spring are housed, a cam hole is formed thereon, and a joint-case assembly that limits the stroke of the outer-box assembly over the inner box-assembly, generates a high-voltage pulse by series of operations where one-way-pressure force is applied with a hammer pin inserted into the hammer, the cam groove, and the cam hole to compress and release the hammer spring. The hammer strikes the piezoelectric element by releasing the compression force of the hammer spring, the operation mechanism is shielded with the joint-case assembly.

2 Claims, 5 Drawing Sheets

PIEZOELECTRIC MECHANISM FOR GENERATING DISCHARGE VOLTAGE

FIELD OF THE INVENTION

This invention relates to a piezoelectric spark-voltage generation mechanism for ignition of gas lighter and the like, especially to a piezoelectric mechanism that assures reliable firing even in frequent operations by preventing sands or dusts from coming into the operation mechanism from the outside.

TECHNICAL BACKGROUND

Spark-voltage generation mechanisms for gas lighters and the like in the prior arts utilize a cam mechanism operating in a series of actions that a hammer strikes a piezoelectric element and generates a high-voltage pulse by releasing a compressed spring, in which the spring is compressed and released by applying only one-way compression force, as described in the patent references below.

This piezoelectric mechanism is provided with apertures of the cam holes in both flanks of the inner box along which the hammer moves. A hammer pin connected with the hammer moves along the edge of the cam hole, at the same time, the hammer pin moves following the L-shaped cam-groove on the outer box. The combination of this movement enables the function of striking the piezoelectric element to generate the high-voltage pulse and igniting the gas by just pushing the mechanism in only one way.

Patent reference 1 Publication Jitsu Kou Shou62-18846
Patent reference 2 Publication Tokkai Hei 5-66014

DISCLOSURE OF THE PRESENT INVENTION

Problems to be Solved by the Present Invention

However, piezoelectric mechanisms in the prior arts exposed cam holes and the like on the inner box and the main body of the lighter, and these mechanisms suffered from incoming sands and dusts that caused failure functions of the movement portions, which resulted in troubles such as hard and reluctant mechanical operation and loss in generation voltage.

Therefore, the present invention intends to provide with a piezoelectric spark-voltage generation mechanism for ignition applicable for gas lighters and the like that assures reliable firing even in frequent operations by preventing sands or dusts from coming into the operation mechanism.

Means to Solve the Problem

The piezoelectric spark-voltage generation mechanism for ignition by the present invention is provided with a base piece, a piezoelectric element, and an anvil housed in the longitudinal axis, and with an outer-box assembly forming a groove in the longitudinal axis on the wall, with an inner-box assembly forming a cam hole that houses a hammer for striking the piezoelectric element and a hammer spring, and with a joint case assembly that limits the stroke of said outer assembly against said inner assembly, and with an operation mechanism that makes a series of functions of generating a high-voltage pulse by striking the piezoelectric element on release and expansion of the compressed spring by using the force of compression and expansion of the hammer spring under application of one-directional compression force guided with a hammer pin inserted into said hammer, a cam notch, and the cam hole, comprises a joint-case assembly that encloses said operation mechanism to prevent ingress of foreign bodies.

Effects of the Present Invention

The piezoelectric spark-voltage generation mechanism for ignition by the present invention comprising a joint-case assembly that completely encloses all the moving elements such as the hammer in the inner-box assembly, the hammer spring, the hammer pin, the cam hole, and the return spring under any states in a series of the igniting functions prevents ingress of sands and dusts and the like, therefore guards the hammer spring and the return spring in the joint case from corrosion.

Even at the state when the cylinder of the outer-box assembly is fully pressed down, by forming a gap between the bottom face of the outer-box assembly and the top surface of the joint case, the operation of pressing down the outer box is not resisted since the gap is thick enough to accommodate the ingress sands and dusts there. As a result, even a long-time use under any environments for operations causes no malfunction.

The piezoelectric spark-voltage generation mechanism for ignition enclosed in the joint case by the present invention need not enlarge its size in comparison with the piezoelectric mechanism by conventional arts, and may be settled in an ordinary gas lighter with current arts of manufacturing without particular changes in design.

EXPLANATION OF THE NUMERALS

Figure 1A:
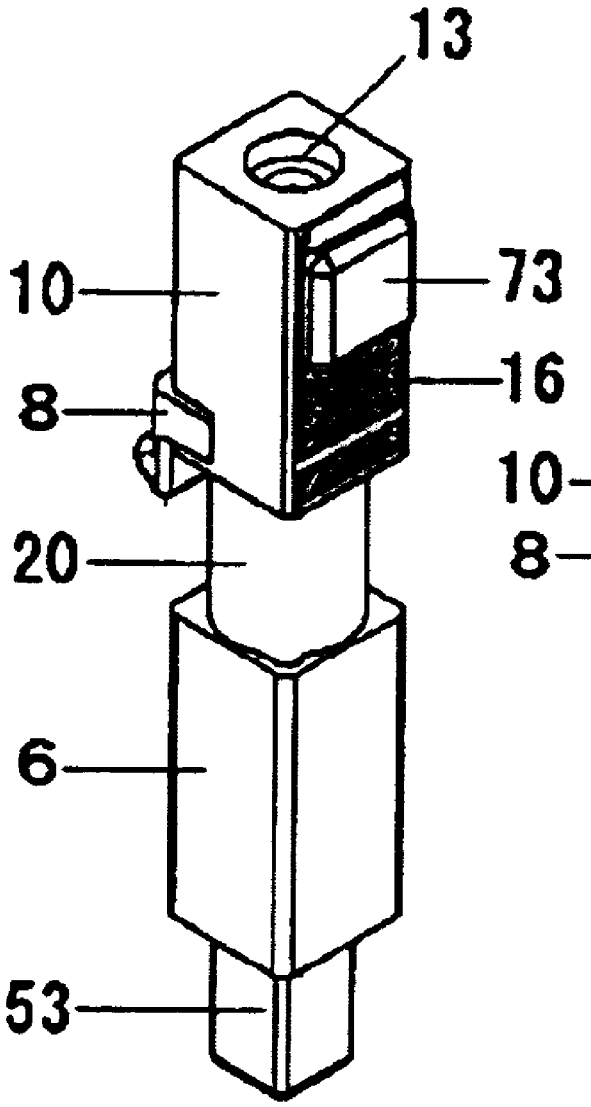
FIG. 1 shows an oblique view of the completely assembled piezoelectric sparking-voltage generator mechanism in the present invention at the stationary state (a) and the operating state (b).

A outer-box assembly
B inner-box assembly
C joint-case assembly
1 outer box
3 L-shaped cam groove
4 cam hole
5 inner box
6 joint case
8 lever pusher
10 box-shaped portion
11 retainer hole
12 base-piece support
13 insertion hole
14, 15 recess
16 glue
20 cylindrical portion
21 longitudinal groove
22 notch
23 projection
51 cylindrical portion
52 flange
53 box-shape portion

54 step portion
55 projection streak
71 piezoelectric element
72 striker
73 anvil
74 pressure spacer
75 hammer
76 pin hole
77 hammer pin
78 hammer spring
79 return spring
81 projection

THE BEST EMBODIMENT OF THE PRESENT INVENTION

Figure 1B:
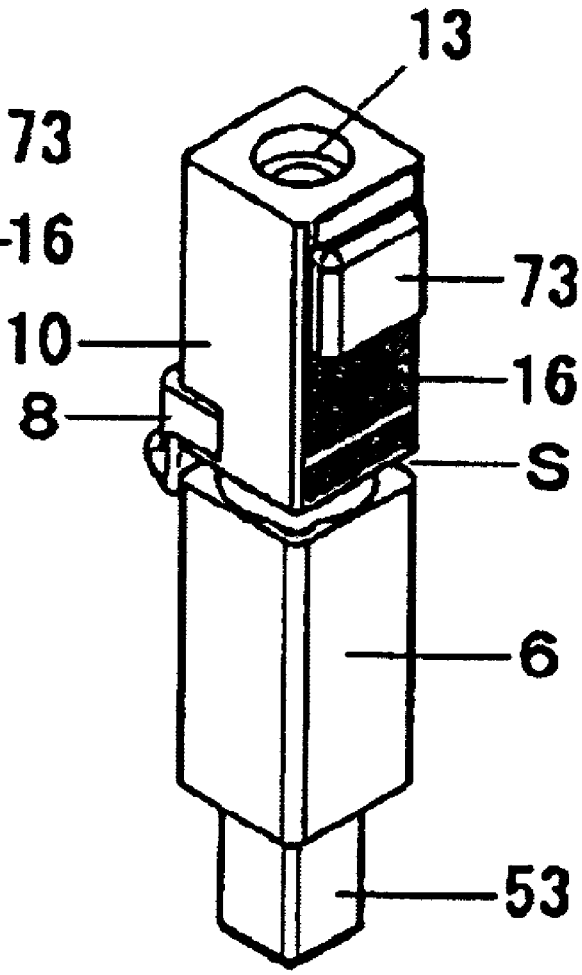
Figure 2:
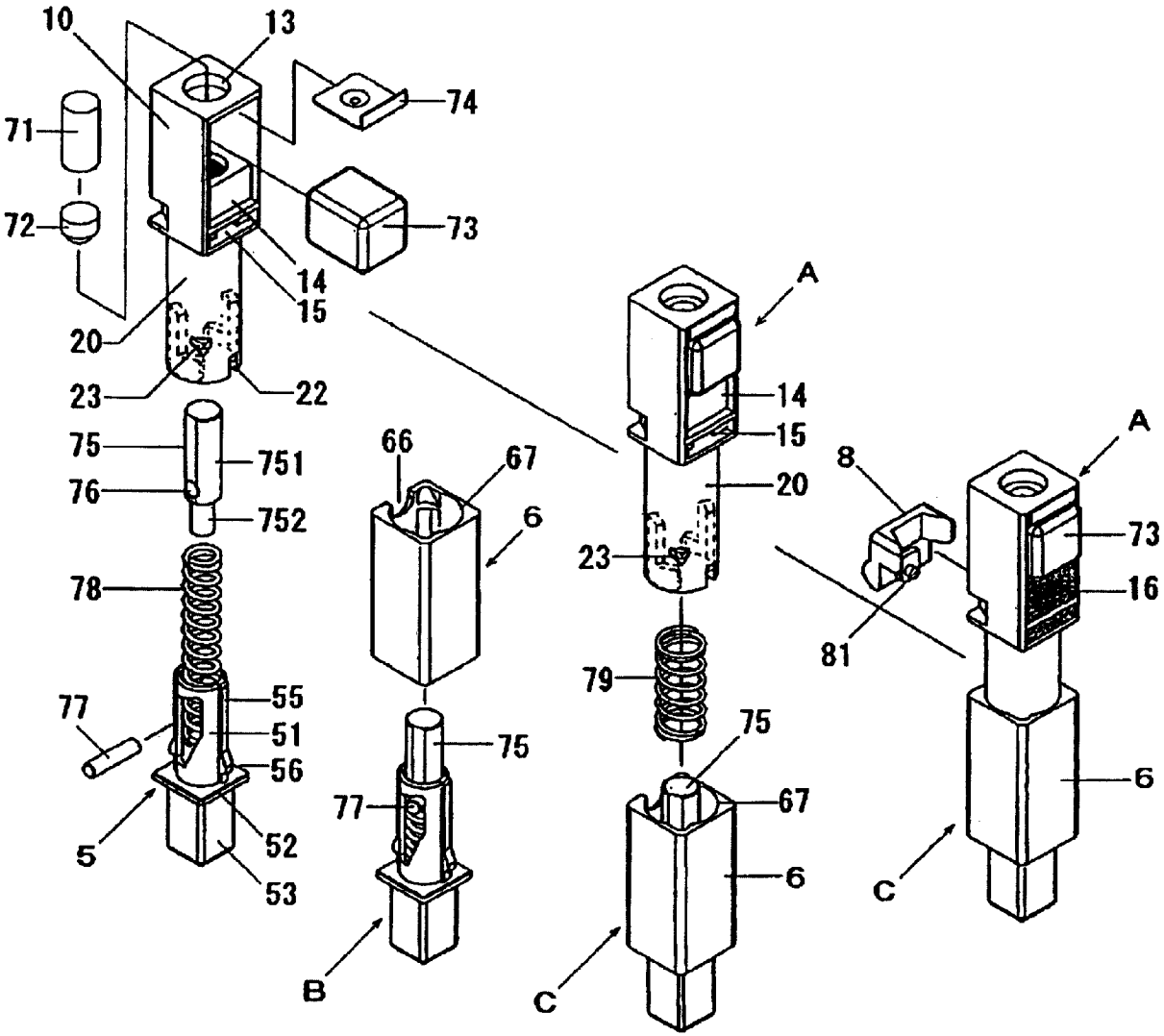
FIG. 2 shows an assembling process of the piezoelectric mechanism of the present invention.

FIG. 1 shows an oblique view of the completely assembled piezoelectric mechanism, wherein FIG. 1(*a*) presents a stationary state and FIG. 1(*b*) presents an operating state. FIG. 2 shows an assembling setup and FIG. 3 shows a vertical sectional view for an assembling process.

The piezoelectric mechanism by the present invention consists of an outer-box assembly A in which a piezoelectric element 71 generating a high-voltage pulse for lighting is installed in an outer box 1, an inner-box assembly B in which a striking hammer 75 is installed, and a joint case 6 that connects the outer-box assembly A and the inner-box assembly B and encloses the moving members such as hammer pin and the cam, and also limits the stroke of the outer-box assembly A against the inner-box assembly B.

The outer box 1, the inner box 5, and the joint case 6 are formed of plastic materials such as poly-athetal that is strong and free against frictional wear.

Figure 3:
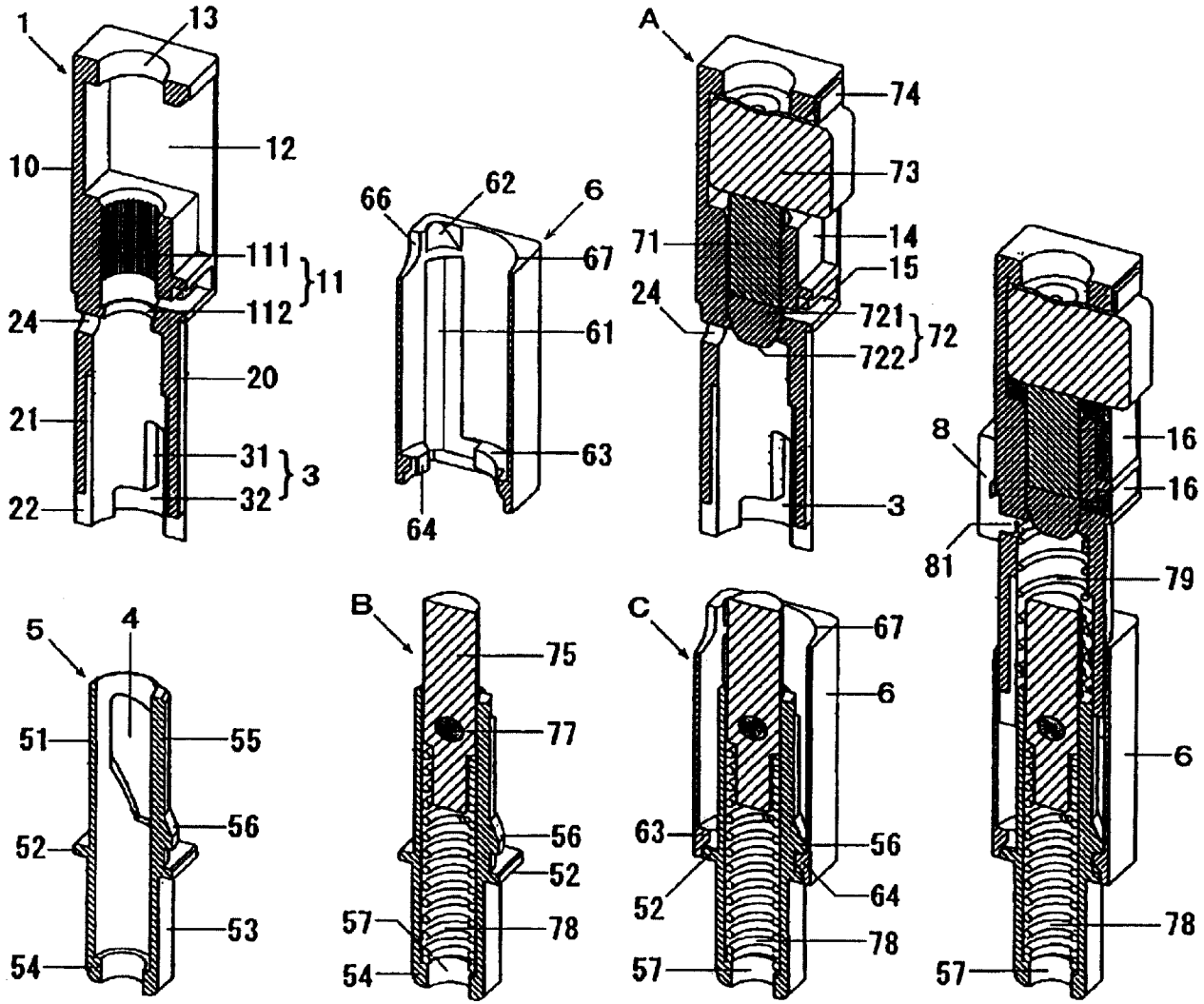
FIG. 3 shows a cross-sectional view of the assembling process.

As shown in FIGS. 2 and 3, the outer box 1 consists of an upper monocock-formed rectangular portion 10 and lower cylindrical portion 20. The rectangular portion 10 in the outer box 1 has a round insertion hole 13 opened on the top, a base-piece retainer 12 opened at the right in front, and a retainer hole 11 with rollets 111 and a ramp 112 at the bottom. The diameter of the retainer hole 11 is almost the same as those of the piezoelectric element 71 and the anvil 72. The cylindrical portion 20 that is monocock-formed together with the box portion 10 has a through hole 24 on the flank into which a projection 81 of the lever pusher is inserted as shown in FIGS. 2 and 3.

The cylindrical portion 20 on the lower side of the outer box 1 is formed as monocock body together with the rectangular portion 10, on the inner round face of which two longitudinal grooves 21 along which the projection streak 55 of the inner box 5 slides and an L-shaped cam groove 3 on which the hammer pin 77 slides are respectively formed symmetrically with respect to the center. At the bottom end of the longitudinal groove 21, notches 22 through which the engaging projection 56 goes in and out are symmetrically formed with respect to the center.

Furthermore, a through hole 24 into which the projection 81 of the lever pusher 8 is inserted is opened at the flank of the cylindrical portion 20, and two projection lugs 23 are symmetrically formed with respect to the center at the bottom of the outer face of the cylindrical portion 20. Further detailed description will be presented together with the assembly process and the operation of the whole piezoelectric mechanism.

As shown in FIGS. 2 and 3, the anvil 72 is formed of a cylindrical portion 721 and half-sphere portion 722. The half-sphere portion 722 whose diameter is smaller than that of the cylindrical portion 721 has a ramp. The piezoelectric element 71 has a cylindrical shape.

The anvil 72 is inserted through the insertion hole 13 at the top of the outer box 1, and the ramp of the anvil 71 is retained with the ramp 112 of the retainer hole 11, to the top of which the piezoelectric element 71 is inserted and is sustained with the rollet portion 111. The top half-sphere 722 of the anvil 72 retained with the ramp on the retainer hole 13 is projected through the ramp 112 of the box-shaped portion 10 into the inside of the cylindrical portion 20.

The base piece 73 that receives the impact is inlaid on the flank over the top of the piezoelectric element 71 peeping upward from the bottom face of the base-metal retainer 12, and the side face of the base piece 73 is exposed outside from the base metal retainer 12. Then, a pressing spacer 74 made of a leaf spring inserted through the flank to the gap between the top surface of the base metal 73 and the base piece retainer 12 fixes them.

Then, a glue of epoxy resin 16 is injected into the dip 14 adjacent to the base-piece retainer 12, and the glue 16 fills the lower-side space of the base piece 73 and the gaps around there, and flows into the gap between the rollet 111 and the piezoelectric element 71, and then the rest of the glue flows over the other dips 15 squeezing the air out, and hardens.

As explained above, if the glue is filled into the gap between the rollet 111 and the piezoelectric element 71 and is hardened under condition that no air bubble is generated, then no electrical leakage occurs for the high-voltage pulse generated on the both ends of the piezoelectric element 71. Finally, the outer-box assembly A is completely assembled by attaching to the box-shaped portion 10 a lever pusher 8 that transmits the down-pushing force against the outer-box assembly A to the lever of the gas-jet nozzle and opens the lever.

When the lever pusher 8 is attached to the box-shaped portion 10 as explained above, since a projection 81 of the lever pusher 8 is plunged into the inside of the cylindrical portion 20 through the through hole 24 dug on the flank of the cylindrical portion 20, the gas-jet nozzle is electrically conducted to the bottom of the piezoelectric element 71 with the return spring 79.

As shown in FIGS. 2 and 3, the inner box 5 is formed in a monocock body with the upper cylindrical portion 51, the lower box-shaped portion 53, and the rectangular flange 52 disposed between the cylindrical portion 51 and the box-shaped portion 53. A through pass that penetrates the cylindrical portion 51 and the box-shaped portion 53 in the longitudinal axis is opened and a step portion 54 that supports the bottom of the hammer spring 78 is formed at the lower end of this hole.

On the outer circle of the cylindrical portion 51, two projection streaks 55 are symmetrically formed with respect to the center that slide along the longitudinal groove on the inner round face of the cylindrical portion 20 of the outer box 1. Around the bottom end of each projection streak 55, an engaging tub 56 that engages with the engaging tub 64 of the joint case 6 is formed. Furthermore, the cylindrical portion 51 has two cam holes 4 symmetrical with respect to the center along which the hammer pin 77 slides. These two cam holes 4 are dug between two projection streaks 55.

Figure 4:
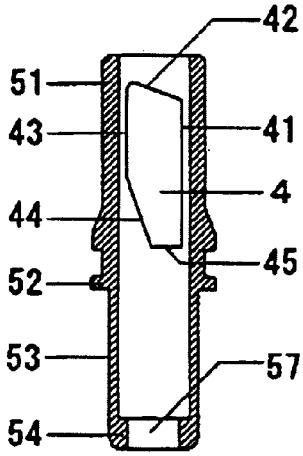
FIG. 4 shows a vertical section of the inner box.
Figure 5A:
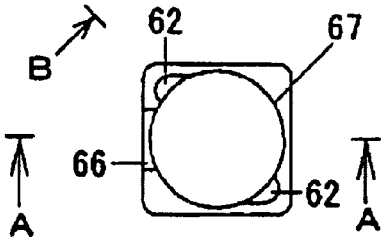
FIG. 5 shows a plan (a), a base view (b), a cross section (c) cut with the line A-A in the plan (a), and cross section (d) cut with the line B-B in the plan (a).
Figure 5C:
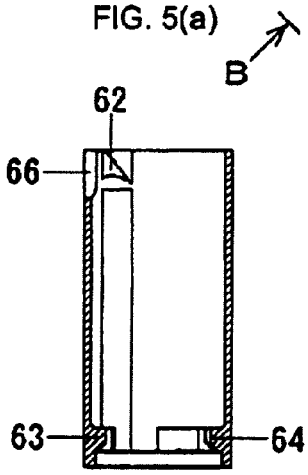
Figure 5D:
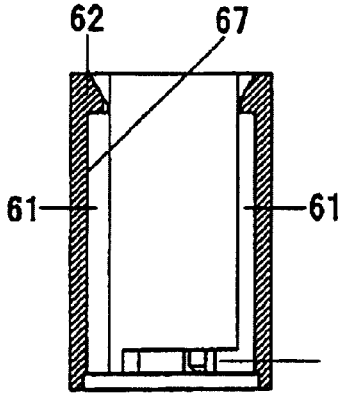
Figure 5B:
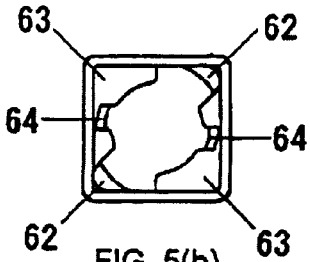

As shown in the cross-sectional view of FIG. 4, the cam hole 4 has a pentagonal shape and is surrounded with a long side 41 that is parallel with the axis, a short side 42 that crosses the axis with an obtuse angle, a g<h-shaped side that consists of a short side 43 parallel with the axis and a hypotenuse side that crosses the axis with an acute angle, and a short side 45 that crosses the axis at a right angle.

As shown in the assembling diagram of FIG. 2, the hammer 75 that consists of a lower cylindrical portion 752 that is short and small in diameter and an upper cylindrical portion 751 that is long and large in diameter, forms a step portion at the boundary between the upper and the lower cylindrical portions 751 and 752.

The upper cylindrical portion 751 that forms a main part of the hammer 75 has a diameter that enables it to move sliding along the hole of the inner box 5. The smaller cylindrical portion 752 at the lower side of the hammer 75 is as small as the inner diameter of the hammer spring 78 since it is inserted into the hammer spring 78. Near the step of the larger cylindrical portion 721, a pinhole 76 is opened that penetrates the cylindrical portion 721.

The assembling process pushes the hammer spring 78 into the hole on the inner box 5 and retains it with the step portion 54 at the bottom end of the hole, then inserts the small cylindrical portion 752 of the hammer 75 onto the hammer spring 78 and pushes down the hammer 75 against the elastic force of the hammer spring 78.

When the pin hole 76 of the hammer 75 reaches the cam hole 41 the hammer pin 77 is inserted from the sideway to this pin hole as shown in FIG. 2. Then, the inner box assembly B is comnpletely assembled in FIGS. 2 and 3 after the down-pushing force of 75 is released.

Although the hammer pin 77 is freely movable rotationally, upward, and downward in the cam hole 4, it is pushed still at the stationary position of the corner at which intersect a short side 42 that crosses the axis with an obtuse angle and a short side 43 that is parallel with the axis.

Next, the joint case 6 is explained with references of FIG. 5. AS shown in a plan of FIG. 5(*a*), a base view of FIG. 5(*b*), a vertical cross-sectional view of FIG. 5(*c*) cut with the line A-A in the plan (a), and a vertical cross-sectional view of FIG. 5(*d*) cut with the line B-B in the plan (a), the joint case 6 forms two longitudinal grooves 61 at the corner symmetrically with respect to the center along which two engaging projections 23 disposed on the cylindrical portion 20 of the outer box 1 slide. At the top end of these two longitudinal grooves 61, two stoppers 62 are formed to terminate the grooves. The stoppers 62 engage with the engaging projections 23 on the cylindrical portion 20 of the outer box 1 to limit the upper stroke of the outer box 1.

As shown in the base view of FIG. 5(*b*), near the bottom end of the round hole 67 of the joint case 6, a stopper 63 is formed to which the flange 52 of the inner box 5 contacts from the bottom, and further an engaging projection 64 is formed with which the engaging projection 56 of inner box 5 engages. Note that the code number 66 in FIGS. 2 and 3 represents a recess in which the step portion surrounding the projection 81 of the lever pusher 8 drops when the outer assembly A is pushed down.

In the following, an assembling process is explained on the piezoelectric mechanism with the outer-box assembly A, inner-box assembly B, and the joint case 6.

As shown in FIGS. 2 and 3, the joint case 6 is inserted into the inner-box assembly B, when the angle of the engaging projection 64 of the joint case 6 is adjusted to that of the engaging projection 56 of the inner-box assembly B, and then as shown in FIG. 3, the flange portion 40 of the inner-box assembly B contacts the stopper 63 of the joint case 6, at the same time, the engaging projection 64 of the joint case 6 engages with the engaging projection 56 of the inner-box assembly B, which combines the inner-box assembly B and the joint case 6 and completes the joint-case assembly C.

Next, as shown in FIGS. 2 and 3, a return spring 79 that has a larger inner diameter than the outer diameter of the hammer 75 is inserted to the round hole 67 in the joint-case assembly C, and then the cylindrical portion 20 of the outer-box assembly A is pushed into the joint-case assembly C against the elastic force of the return spring 79.

When the cylindrical portion 20 is pushed down, the projection streak 55 formed on the outer round face of the cylindrical portion 51 of the inner-box assembly B slides on the longitudinal groove 21 formed on the inner round face of the cylindrical portion 20 in the outer box 1, and the projection 23 formed on the outer face of the cylindrical portion 20 in the outer box 1 is settled in the joint case 6 crossing over the stopper 62 on the longitudinal groove 61, changing the shape of the joint case 6.

Since the cylindrical portion 20 of the outer box 1 is pushed down into the joint case 6 whose shape is changed with the inserting projection 23, there is no gap between the cylindrical portion 20 of the outer box. 1 and the round hole 67 in the joint-case assembly C, and then there come in no sands or dusts. Once the guide projection 23 is settled in the joint case 6, it does not go out crossing over the stopper 62.

Since two L-shaped cam grooves 3 are formed on the inner round face of the cylindrical portion 20 of the outer box 1 symmetrically with respect to the center, the top ends of the hammer pin 77 projected to both sides from the cam hole 4 of the inner box 5 are disposed to be at the ends of the surface 32 crossing the axial direction of the cam groove 3.

Figures 6A, 6B, 6C, 6D, 6E, 6F, 6G:
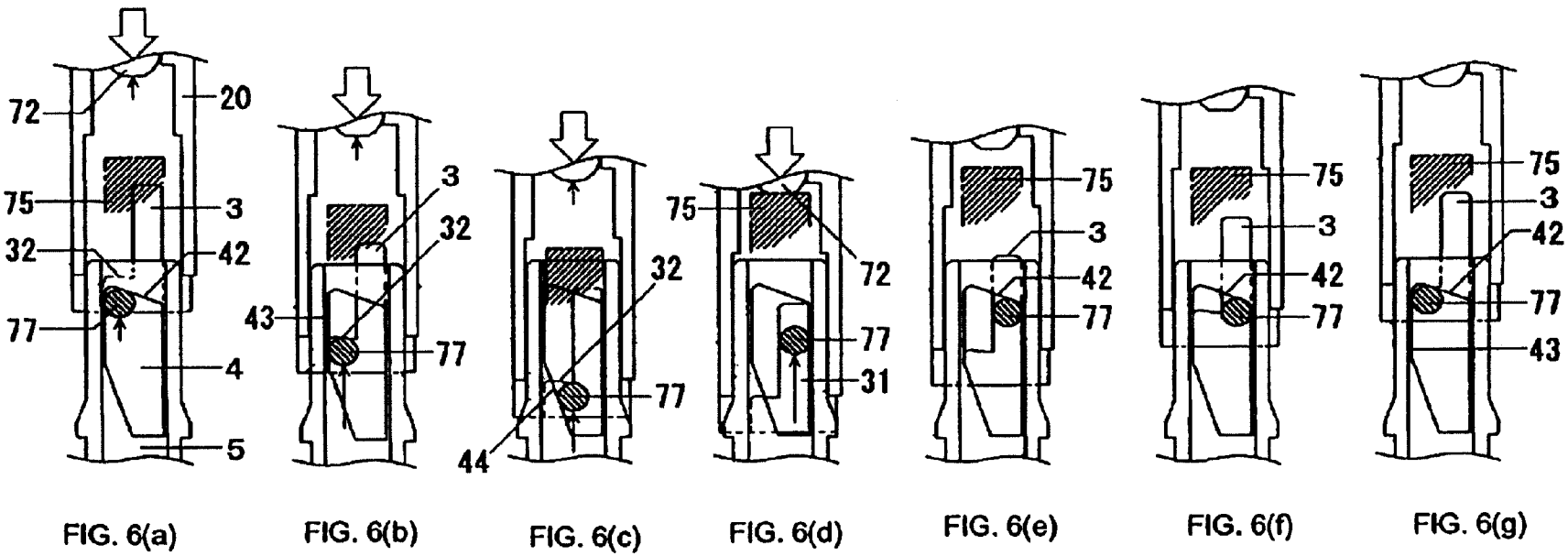
FIG. 6 shows a diagram in a time sequence to explain the operation of the piezoelectric mechanism in the present invention.

Operations of the piezoelectric mechanism as assembled in the process above are explained with references of FIG. 6.

When the outer-box assembly A is pushed down against the elastic force of the hammer spring 78 from the stationary state in FIG. 6(*a*), the hammer pin 77 of the inner-box assembly B is pushed down together with the hammer 75 following the face 32 that crosses the axis direction of the L-shaped cam groove 3 on the outer-box assembly A as shown in FIG. 6(*b*). Then the face 32 crossing the axis direction of the cam groove 3 does not fall into the vertical groove 31 but falls down on the vertical short side 43 of the cam hole 4 since the face 32 is slightly slant to the face crossing the axis direction with right angle.

When the hammer pin 77 of the inner-box assembly B reaches the oblique side 44 of the cam hole 4, as shown in FIG. 6(*c*), the hammer pin 77 rotates along the face 32 that crosses the oblique side 44 of the cam hole 4 and the axis direction of the L-shaped cam groove 3.

The hammer pin 77 of the inner-box assembly B further rotates and reaches the vertical groove 31 of the L-shaped cam groove 3, then as shown in FIG. 6(*b*), the elastic force of the hammer spring 78 raises the hammer pin 77 along the vertical groove 31, and at the same time, raises the hammer 75 as well which strikes the anvil 72 of the outer-box assembly A. This impact force to the anvil 72 is transmitted to the piezoelectric element 71, which generates a high-voltage pulse that ignites the spouting gas.

In addition, even though the cylindrical portion 20 of the outer-box assembly A is fully pushed down, as shown in FIG. 1(*b*), the design configuration determines the length of the cylindrical portion 20 so that a gap S remains between the bottom face of the box-shaped portion 10 and the top face of the joint case 6. This gap prevents sands or dusts from coming into the lighter body and causing malfunctions as an obstacle against the downward movement of the outer-box assembly A, since the gap S is wide enough to settle the sands and the dusts inside.

After the combustion, when the downward force to the outer-box assembly A is released, as shown in FIG. 6(*a*), the outer-box assembly A is pushed back with the elastic force of the return spring 79 and the L-shaped cam groove 3 rises upward without rotating the hammer pin 77

When the face 32 crossing the axis direction of the L-shaped cam groove 3 rises up and reaches the hammer pin 77 as shown in FIG. 6(*f*), the hammer pin 77 rotates around the short and gentle oblique side 42 of the cam hole 4 by the elastic force of the hammer spring 78 as shown if FIG. 6(*g*), and returns to the stationary position at the acute-angle corner of the cam hole 4, which terminates a series of the operations.

As explained above, when the down force of the outer-box assembly A is released, the projection 23 of the outer box 1 has contact with the inside of the stopper 62 on the joint case 6, which prevents the cylindrical portion 20 of the outer-box assembly A from slipping out of the joint case 6.

Although above explained is about the case that the outer-box assembly A is disposed upside and the inner-box assembly B is disposed downside, no problem is with the outer-box assembly A disposed downside and the inner-box assembly B disposed upside. On the other hand, the high-voltage pulse generated with the piezoelectric element 71 may be conducted using a conductive material such as an electrically conductive resin that is inserted through a hole 57 on the box-shaped portion 53 of the inner-box assembly B to contact the hammer spring 78, instead of installing the lever pusher 8.

Furthermore, although the preferable embodiment above explained disposes the L-shaped cam groove 3 that consists of the longitudinal groove 31 and the face 32 crossing the axis of the cylindrical portion 20 of the outer-box assembly A, the face 32 that crosses the axis may be replaced with the bottom face of the cylindrical portion 20.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A piezoelectric spark-voltage generation mechanism for ignition that is provided with a base piece, a piezoelectric element, and an anvil housed in the longitudinal axis, an outer-box assembly on which a cam groove is formed in the longitudinal axis, an inner-box assembly in which a cam hole is formed and a hammer spring and a hammer for striking the piezoelectric element is housed, a joint-case assembly that limits the stroke of said outer assembly against said inner assembly, and an operation mechanism that makes a series of functions of generating a high-voltage pulse by striking the piezoelectric element on release and expansion of the compressed spring by using the force of compression and expansion of the hammer spring under application of one-directional compression force guided with a hammer pin inserted into said hammer, the cam groove, and the cam hole, comprises the joint-case assembly that encloses said operation mechanism to prevent foreign bodies from coming in, wherein the hammer pin is enclosed in the joint-case assembly.

2. A piezoelectric spark-voltage generation mechanism for ignition in claim 1 comprising a gap formed during the operation between the box-shaped portion of the outer-box assembly and the top end of the joint case.

* * * * *